US008956000B2

(12) United States Patent
Martinez

(10) Patent No.: US 8,956,000 B2
(45) Date of Patent: Feb. 17, 2015

(54) SYSTEM AND METHOD FOR ILLUMINATION OF A RAIN GUTTER

(76) Inventor: Stephane Martinez, Chesterfield, MO (US)

( * ) Notice: Subject to any disclaimer, the term of this patent is extended or adjusted under 35 U.S.C. 154(b) by 241 days.

(21) Appl. No.: 13/554,757

(22) Filed: Jul. 20, 2012

(65) Prior Publication Data

US 2014/0022767 A1 Jan. 23, 2014

(51) Int. Cl.
*F21V 21/00* (2006.01)

(52) U.S. Cl.
USPC ..... 362/151; 362/311.01; 362/311.13; 362/311.14; 362/370; 40/580

(58) Field of Classification Search
USPC ..... 362/151, 213, 311.01, 311.04, 311.13, 362/311.14, 368, 370, 293, 806; 40/580
See application file for complete search history.

(56) References Cited

U.S. PATENT DOCUMENTS

| | | | | | |
|---|---|---|---|---|---|
| 736,722 | A * | 8/1903 | Hall | 40/580 |
| 3,204,090 | A * | 8/1965 | Kvarda, Jr. | 362/249.01 |
| 3,692,993 | A * | 9/1972 | Robinson | 362/249.07 |
| 4,128,863 | A * | 12/1978 | Premetz | 362/249.01 |
| 5,311,414 | A * | 5/1994 | Branham, Sr. | 362/249.11 |
| 5,707,136 | A * | 1/1998 | Byers | 362/145 |
| 5,813,751 | A * | 9/1998 | Shaffer | 362/249.08 |
| 6,076,938 | A * | 6/2000 | Kinderman | 362/145 |
| 6,644,836 | B1 * | 11/2003 | Adams | 362/396 |
| 6,955,458 | B2 * | 10/2005 | Cheema | 362/581 |
| 7,306,354 | B2 * | 12/2007 | Haas | 362/432 |
| 7,488,018 | B2 * | 2/2009 | Rommelmann, Jr. | 294/209 |
| 7,631,982 | B1 * | 12/2009 | D'Onofrio | 362/151 |
| 2002/0144441 | A1 | 10/2002 | Zentmire et al. | |
| 2003/0198054 | A1 | 10/2003 | Adams | |
| 2007/0114337 | A1 | 5/2007 | Rommelmann, Jr. | |
| 2011/0107683 | A1 | 5/2011 | Ringuette | |

FOREIGN PATENT DOCUMENTS

JP 2008202367 A 9/2008

OTHER PUBLICATIONS

International Search Report, International Patent Application No. PCT/US13/51229, mailed on Oct. 7, 2013, 11 pages.

* cited by examiner

*Primary Examiner* — Ismael Negron
(74) *Attorney, Agent, or Firm* — Lewis, Rice & Fingersh, L.C.

(57) ABSTRACT

A rain gutter illumination system including an inverted U-shaped hanger, an illuminable surface attached to a stem of the hanger and including an aperture, an L-shaped base including a foot at one end, the end of the base opposite the foot being attached to the end of the illuminable surface opposite the hanger. A light source and one of various removable decorative inserts and optionally a diffusing panel are arranged so that the light source projects light through the aperture of the illuminable surface.

10 Claims, 5 Drawing Sheets

SYSTEM AND METHOD FOR ILLUMINATION OF A RAIN GUTTER

BACKGROUND

1. Field of the Invention

This disclosure relates to the field of illumination for residential and commercial structures. In particular, to the use of rain gutters and similar structural elements for decorative illumination.

2. Description of the Related Art

Commercial and residential buildings are usually decorated in some fashion. While illumination is generally a practical element of a structure, lighting also serves a dual role as décor. The décor of a structure often varies through the seasons, holidays, and during special events, and specialized lighting may be used to augment these variations in décor. In particular, it is a nearly universal practice in the United States to decorate both the interior and exterior of practically any structure with strings of small lights during the Christmas season.

For exterior lighting, specialized lighting is often hung from the rain gutters attached to the home or other structure. Attaching lighting to a rain gutter is particularly desirable because the linear design of a rain gutter, combined with its usual location along the edges of roof surfaces, creates a bright, aesthetically-pleasing affect by highlighting the major surfaces of the building and drawing attention to the structure. The lights are meant to inspire in both the decorator and viewer a sense of mirth and warmth, despite the cold weather and short winter days.

However, rain gutters are a particularly difficult structural element to decorate because the gutter is designed to channel water, not accept decorations. Rain gutters are designed to support the relatively evenly-distributed weight of water flowing through the gutter trough and, in particular, the side walls of the rain gutter are designed to withstand the relatively low lateral pressure of parallel water flow, and not to support an amount of weight attached at any one point. Further, the time of year when people most wish to decorate rain gutters—winter—is the very time of year that gutters tend to be under the greatest stress, caused by the presence of ice or snow in the gutter trough. Thus, to avoid damaging the gutter or the item being hung from it, decorators avoid the use of heavy decorations on rain gutters.

Also, the materials used in rain gutter construction present problems. While rain gutters can be constructed from a wide variety of materials, ranging from steel to wood to concrete, most modern rain gutters are made from light metals and plastics, such as aluminum and vinyl. These materials are smooth and have low coefficients of friction, which makes it difficult to attach decorations or use adhesives. The decorator also cannot get around this by drilling holes in the gutters because the holes lower the overall structural strength of the gutter and impair the rain gutter's ability to capture and channel water. Additionally, rain gutters are a highly visible structural element and a rain gutter full of visible punctures gives the entire structure the undesirable appearance of a ramshackle, poorly-maintained building, lowering property and/or lease value.

Thus, decorators are confined to hanging only very light decorations from rain gutters, such as strings of small Christmas lights, and they do so using specialized equipment, such as light plastic or metal clips that attach to the nose of the gutter and provide a projection from which to hang the light string. In order to present the desirable linear appearance in the string of lights, many dozens of these clips must be attached closely together to preventing sagging in the light strings. In practical terms, this means the decorator must spend a significant amount of time balanced at the top of a ladder or precariously perched at the edge of the roof in order to attach these clips and hang the lights from them and then to take them all down again when the holiday season has passed.

For structures with high eaves, this task is particularly dangerous, and falls can result in serious injury. The Center for Disease Control reports that from 2000 to 2003 alone, more than 15,000 people were treated in emergency rooms for fall-related injuries sustained while hanging Christmas decorations. [CDC Fall-Related Injuries During the Holiday Season (2004)]. While Christmas is the primary season for decorating rain gutters, lights for other seasons, notably Halloween, are becoming more common, adding to the risk of injury and damage.

There are few practical methods for decorating a rain gutter, and the available methods are fraught with risk to the decorator, the rain gutter, the decorations, and the building. Thus, rain gutter décor is generally confined to the creative possibilities available with a lightweight string of lights, such as the popular "icicle" affect. Further, the hassle and hazard of decorating rain gutters even with these light strings is serious enough that a market has emerged for small businesses whose sole service offering is to hang and remove Christmas lights. Finally, even though these strings of lights are attractive at night, during the day time the dark wires are highly visible and visually unappealing.

SUMMARY

The following is a summary of the invention which should provide to the reader a basic understanding of some aspects of the invention. This summary is not intended to identify critical components of the invention, nor in any way to delineate the scope of the invention. The sole purpose of this summary is to present in simplified language some aspects of the invention as a prelude to the more detailed description presented below.

Because of these and other problems in the art, described herein, among other things, is a system for illuminating rain gutters. This system utilizes a cover and a source of illumination to project illumination through one or more apertures in decorative shapes so as to project an illuminated representation of the decorative shape of the aperture outwardly to a spectator. Depending on, among other things, the effect desired and the viewing angle of the spectator, the illumination may project in any direction from the structure to which the apparatus is attached.

Described herein, among things, is a rain gutter illumination system comprising: a hanger generally in an inverted U-shape and including a stem having a distal end; an illuminable surface attached to the distal end of the stem and including an interior side, an exterior side opposing the interior side, and an aperture from the interior side to the exterior side; a generally L-shaped base including a leg, a foot having a proximal end attached to the leg and a distal end attached to the illuminable surface; a source of illumination projecting illumination through the aperture such that an illuminated representation of the aperture is projected from the exterior side of the illuminable surface.

In an embodiment, the rain gutter illumination system is further comprised of a diffusing panel insert adjacent to the aperture.

In an embodiment, the diffusing panel insert is generally translucent.

In an embodiment, the diffusing panel insert is generally transparent.

In an embodiment, the rain gutter illumination system is further comprised of a decorative insert adjacent to the aperture and including an interior side, an exterior side opposing the interior side, and an aperture from the interior side to the exterior side.

In an embodiment, the aperture of the decorative insert is in the shape of a seasonally-themed symbol.

In an embodiment, the aperture of the decorative insert is in the shape of a typographical glyph.

In an embodiment, the aperture of the decorative insert is in the shape of a logo or trademark.

In an embodiment, the source of illumination is selected from the group consisting of: single-color lights, multi-color lights, flashing lights, blinking lights, strobe lights, runway lights, black lights.

Also described herein, among other things, is a method for decorative illumination comprising: providing an illumination system comprising a hanger, a base, a source of illumination, and an illuminable surface including an interior side, an exterior side opposing the interior side, and an aperture from the interior side to the exterior side; placing the illumination system on a rain gutter; illuminating the source of illumination to project illumination through the aperture.

In an embodiment of the method, the method further comprises: in the providing, the illumination system further comprises a diffusing panel insert; locating the diffusing panel insert between the source of illumination and the illuminable surface; illuminating the source of illumination to project illumination through the diffusing panel insert.

In an embodiment of the method, the method further comprises: in the providing, the illumination system further comprises a decorative insert including an interior side, an exterior side opposing the interior side, and an aperture from the interior side to the exterior side; locating the decorative insert between the source of illumination and the illuminable surface; illuminating the source of illumination to project illumination through the aperture of the decorative insert.

DESCRIPTION OF PREFERRED EMBODIMENT(S)

Although the present invention is described with particular reference to the accompanying drawings, it is to be understood at the outset that it is contemplated that the present invention may vary in specific detail from that illustrated and described herein while still achieving the desirable characteristics and features of the present invention. Accordingly, the description that follows is intended to be understood as a broad enabling disclosure directed to persons skilled in the applicable arts, and is not to be understood as being restrictive.

Figure 1A:
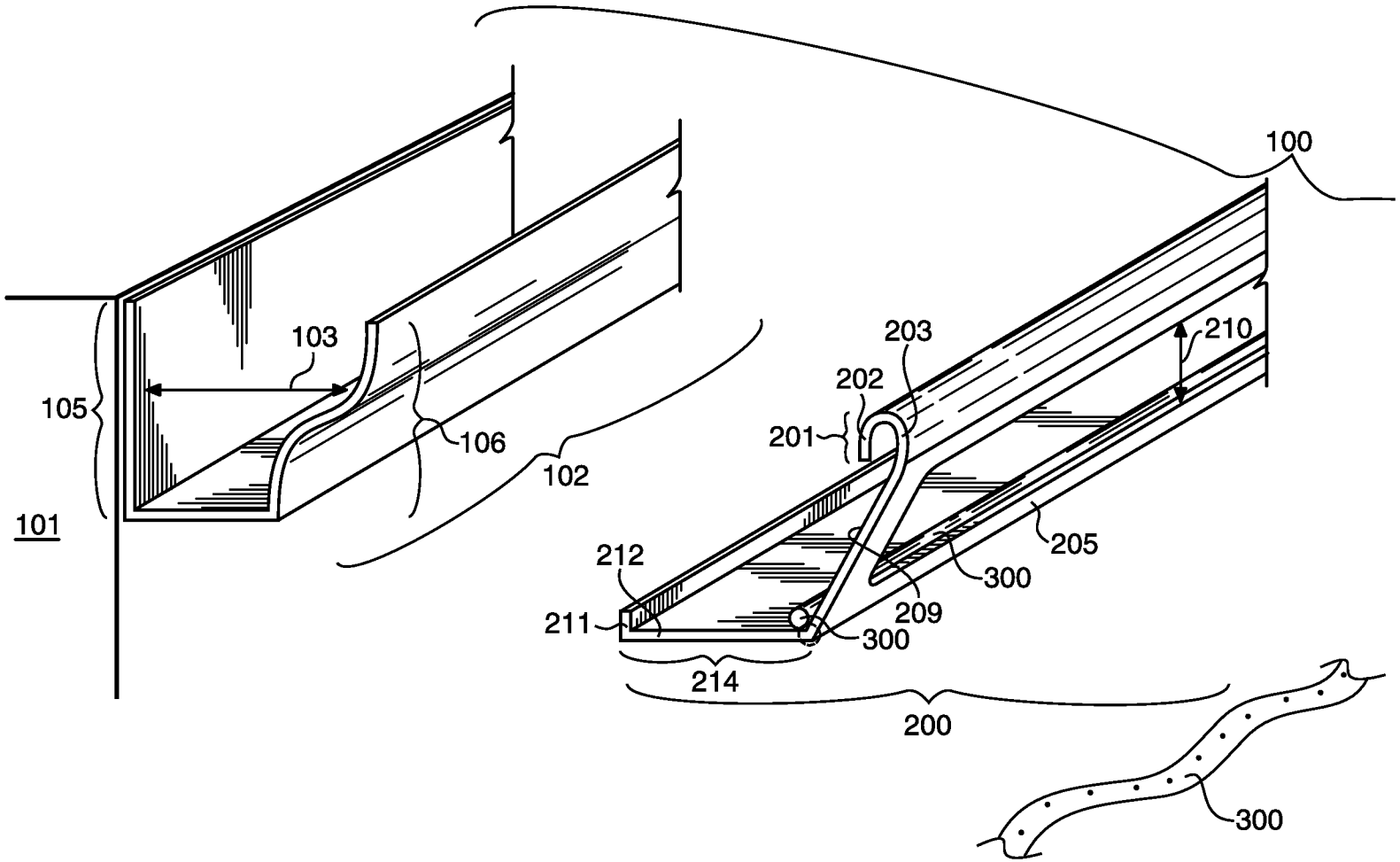
FIGS. 1A-1B provide an exploded view of an embodiment of the rain gutter illumination system. The spatial relationship of the components depicted in FIGS. 1A and 1B are for purpose of clarity and are not intended to represent or imply a spatial relationship between or among the depicted elements.
Figure 1B:
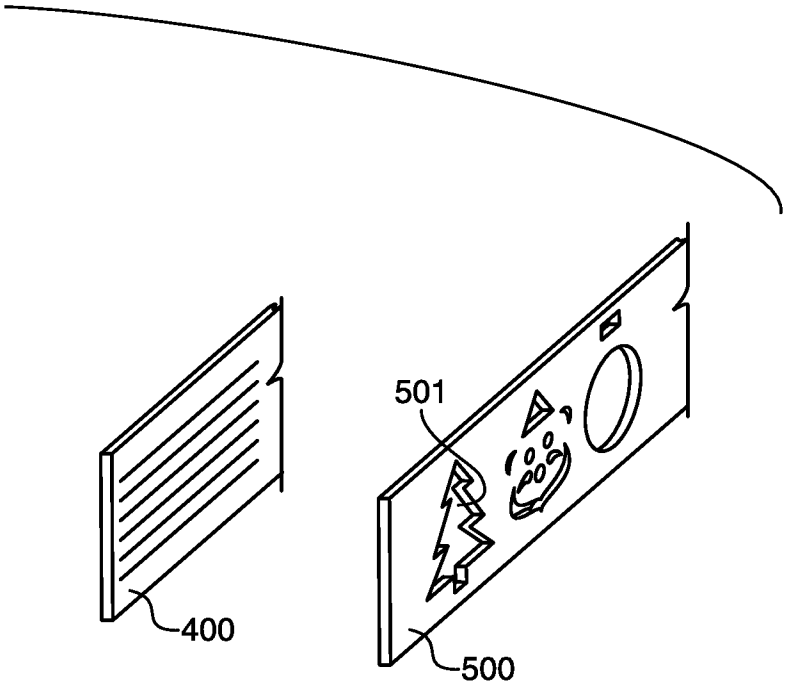

FIGS. 1A and 1B provide an exploded view of an embodiment of the rain gutter illumination system (100). The rain gutter illumination system (100) may consist of an individual rain gutter (102) section or multiple sections attached together. In an embodiment, a plurality of apparatuses is used to illuminate a rain gutter (102). FIGS. 1A and 1B show various components of the system in isolation from one another for sake of clarity and the depicted spatial relationship is not intended to suggest, imply, or represent a relationship between or among the components.

The building (101) is generally a commercial or residential structure but may be any structure to which a rain gutter (102) may be attached. An embodiment of a rain gutter (102) is shown affixed to the building (101) generally parallel to the top of the building (101) but the rain gutter (102) may be attached to the building (101) in any fashion.

The rain gutter (102) will generally be constructed of aluminum or vinyl but may be constructed of any material sufficiently rigid to maintain its own shape (102), including but not limited to: cast iron, lead, zinc, copper, steel, stainless steel, a metal alloy, a galvanized metal or steel, PVC, plastic, vinyl, concrete, stone, or wood. The rain gutter (102) may be adorned or decorated, including but not limited to, by painting, staining, embossing, or antiquing.

In the depicted embodiment, the rain gutter (102) is affixed to the building (101) by the rain gutter's (102) interior wall (105), but in an embodiment the rain gutter (102) may be affixed to the building (101) in any fashion, including but not limited to by use of hardware or other components not depicted in FIG. 1A. In the depicted embodiment, the exterior wall (106) of the rain gutter (102) has a contoured shape and the interior wall (105) is generally a flat, elongated polyhedron, but in an embodiment the specific shape of the interior wall (105) and exterior wall (106) may vary from the depicted embodiment and the characteristics of the channel (103) likewise may vary. The profile shape of the rain gutter (102) may include, without limitation: K-style, O/G, ogee, half-round, quarter-round, plain fascia, tile fascia, curved fascia, curved tile, decco, decco tile, box, box deep, box shallow, rolled box, box bead, rolled box bead, double bead, or winged.

In the depicted embodiment, the cover (200) comprises a single hanger (201) comprising an elongated section attached longitudinally to an embodiment of the illuminable surface (205), which is also an elongated section attached longitudinally to the base (214). In the depicted embodiment, the hanger (201) and the base (214) affix or stabilize the cover (200) to the rain gutter (102) such that the cover (200) will remain mostly stationary once in place.

Figure 6:
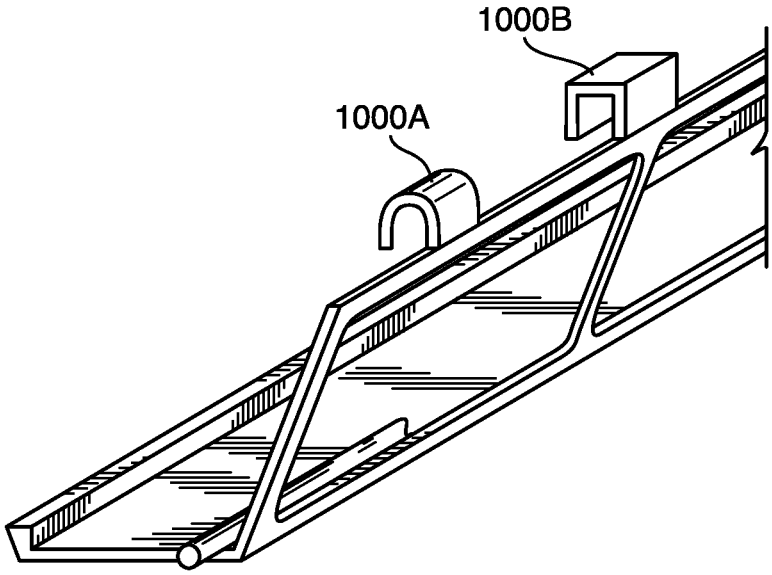
FIG. 6 provides an embodiment of the rain gutter illumination system. In this embodiment, the rain gutter illumination system does not include an embodiment of a diffusing panel, nor of a decorative insert. In this embodiment, there is more than one hanger, and the shape of the hanger varies.
Figure 7:
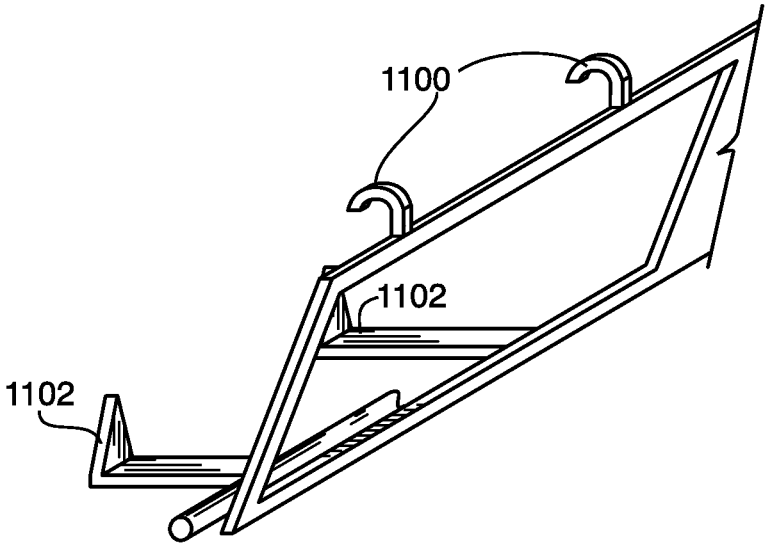
FIG. 7 provides an embodiment of the rain gutter illumination system. In this embodiment, the rain gutter illumination system does not include an embodiment of a diffusing panel, nor of a decorative insert. In this embodiment, the system includes more than one hanger, and more than one base.

In the depicted embodiment, the hanger (201) is sized and shaped for attaching to a rain gutter (102). In the depicted embodiment, the hanger (201) is a single elongated element generally in the shape of a curved, inverted U, with stems (202, 203) of approximately the same length, thickness, and shape. However, in an embodiment, the hanger (201) may be of any size or shape appropriate for attaching to a rain gutter (102) and the specific size and shape of the hanger (201), including but not limited to the quantity, shape, size, length, thickness, spacing, and arrangement of the hanger or hangers (201) will necessarily vary depending on the size and shape of the particular rain gutter (102) with which a given embodiment of the rain gutter illumination system (100) is designed to be used. For example, in the embodiment depicted in FIG. 6, the apparatus includes two hangers (1000A) and (1000B) which are not elongated sections, and which are not the same design, one being curved and the other being orthogonal. Similarly, in the embodiment depicted in FIG. 7, the apparatus again includes two hangers (1100), both being the same design and having one stem that is longer than the other.

The hanger (201) may be made from any material of sufficient rigidity to maintain its own shape and of sufficient strength to support the rain gutter illumination system (100), including but not limited to: aluminum, cast iron, lead, zinc, copper, steel, stainless steel, a metal alloy, a galvanized metal or steel, PVC, plastic, vinyl, concrete, stone, or wood. In an embodiment, the hanger (201) may be made from the same material or materials as another element of the rain gutter illumination system (100). In an embodiment, the hanger (201) may be made from a different material or materials than another element of the rain gutter illumination system (100).

In the depicted embodiment, the base (214) is sized and shaped for attaching to a rain gutter (102). The depicted embodiment of the base (214) is a single elongated element generally in the shape of an orthogonal L, with a short leg (211) extending above the foot (212) and the leg (211) is attached to the foot (212) generally perpendicularly. In the depicted embodiment, the base (214) provides a supporting surface for a source of illumination (300), but in an embodiment the source of illumination (300) may be attached to, or supported by, another element of the rain gutter illumination system (100), including but not limited to by hardware or other components not depicted in FIGS. 1A-1B. In an embodiment, the source of illumination (300) is attached to the illuminable surface (205). In another embodiment, the source of illumination (300) is attached to the rain gutter (102).

In an embodiment, the size and shape of the base (214), including but not limited to the quantity, shape, size, length, thickness, spacing, and arrangement of the base or bases (214) or legs (212) or feet (211) will necessarily vary depending on the size and shape of the particular rain gutter (102) with which a given embodiment of the rain gutter illumination system (100) is designed to be used. For example, in the embodiment depicted in FIG. 7, the apparatus has a plurality of bases (1103), neither of which is elongated and both of which have triangular legs (1102).

In an embodiment of the base (214): there is no leg (211); there is no foot (212); the leg (211) extends above or below the foot (212); the leg (211) is attached to the building (101); the foot (212) is attached to the building; the leg (211) and the foot (212) are arranged in a non-perpendicular fashion; the leg (211) is longer than the foot (212); there is more than one base (214); the base (214) includes more than one foot (212); the base (214) includes more than one leg (211); a foot (212) includes contain more than one leg (211); a leg (211) includes more than one foot (212); the base (214), leg (211), or foot (212) contain one or more apertures, vents, drains, or other openings; the base (214) is T-shaped; the base (214) is shaped other than in an the shape of an L. In an embodiment, the source of illumination (300) projects light through an aperture in the base (214).

The base (214) may be made from any material of sufficient rigidity to maintain its own shape, including but not limited to: aluminum, cast iron, lead, zinc, copper, steel, stainless steel, a metal alloy, a galvanized metal or steel, PVC, plastic, vinyl, concrete, stone, or wood. In an embodiment, the base (214) may be made from the same material or materials as another element of the rain gutter illumination system (100). In an embodiment, the base (214) may be made from a different material or materials than another element of the rain gutter illumination system (100).

In the depicted embodiment, the rain gutter illumination system (100) is attached to the rain gutter (102) by placing the hanger (201) over the exterior wall (106) of the rain gutter (102), and placing the leg (211) of the base (214) between the interior wall (105) of the rain gutter (102) and the building (101). In the depicted embodiment, the base (214) provides support for the source of illumination (300), which is located between the interior side (209) of the illuminable surface (205) and the exterior wall (106) of the rain gutter (102). There are other means by which the cover (200) may be attached to the rain gutter (102) and/or stabilized, including but not limited to static pressure and the use of hardware, adhesives, or other components not depicted in FIGS. 1A-1B.

In the depicted embodiment, the illuminable surface (205) is sized and shaped to provide an aperture (210) through which the source of illumination (300) projects illumination. Also in the depicted embodiment, the illuminable surface (205) is an elongated polyhedron attached longitudinally to an embodiment of a hanger (201) and also attached longitudinally to an embodiment of a base (214). However, the illuminable surface (205) need not be polyhedral and may be, by way of example and not limitation: spheroidal, toroidal, ellipsoidal, or lentoidal.

In the depicted embodiment, the illuminable surface (205) is configured at an angle of approximately 105° to the base (214), and at an angle of approximately 165° to the exterior stem (203) of the hanger (201). In an embodiment, the angles at which the components are attached to each other will vary depending on a number of factors, including but not limited to: the specific size and shape of each component; the size, shape, and orientation of the rain gutter (102); and the location from which spectators view the aperture (210) in the illuminable surface (205).

In an embodiment, the rain gutter illumination system (100) is attached to a rain gutter (102) attached to a building (101) and spectators view the aperture (210) from an elevation lower than the elevation of the rain gutter illumination system (100). In such an embodiment, the angle of the illuminable surface (205) to the base (214) is generally greater than 90°.

In an embodiment, the angle between the illuminable surface (205) and the base (214) is: less than 15°; less than 30°; less than 45°; less than 60°; less than 75°; less than 90°; less than 105°; less than 120°; less than 135°; less than 150°; less than 165°; less than 180°; less than 195°; less than 210°; less than 225°; less than 240°; less than 255°; less than 270°; less than 285°; less than 300°; less than 315°; less than 330°; less than 345°; less than 360°.

In an embodiment, the angle between the interior side (109) of the illuminable surface (205) and the base (214) is: greater than 0°; greater than 15°; greater than 30°; greater than 45°; greater than 60°; greater than 75°; greater than 90°; greater than 105°; greater than 120°; greater than 135°; greater than 150°; greater than 165°; greater than 180°; greater than 195°; greater than 210°; greater than 225°; greater than 240°; greater than 255°; greater than 270°; greater than 285°; greater than 300°; greater than 315°; greater than 330°; greater than 345°.

In an embodiment, the rain gutter illumination system (100) is attached to a rain gutter (102) attached to a building (101) and spectators view the aperture (210) from an elevation higher than the elevation of the rain gutter illumination system (100). In such an embodiment, the angle of the illuminable surface (205) to the base (214) is generally less than 90°.

In an embodiment, the angle between the illuminable surface (205) and the hanger (201) is: less than 15°; less than 30°; less than 45°; less than 60°; less than 75°; less than 90°; less than 105°; less than 120°; less than 135°; less than 150°; less than 165°; less than 180°; less than 195°; less than 210°; less than 225°; less than 240°; less than 255°; less than 270°; less than 285°; less than 300°; less than 315°; less than 330°; less than 345°; less than 360°.

In an embodiment, the angle between the illuminable surface (205) and the hanger (201) is: greater than 0°; greater than 15°; greater than 30°; greater than 45°; greater than 60°; greater than 75°; greater than 90°; greater than 105°; greater than 120°; greater than 135°; greater than 150°; greater than 165°; greater than 180°; greater than 195°; greater than 210°; greater than 225°; greater than 240°; greater than 255°; greater than 270°; greater than 285°; greater than 300°; greater than 315°; greater than 320°; greater than 345°.

In the depicted embodiment, the source of illumination (300) is a light ribbon, but the source of illumination (300) may be any type of lighting, including but not limited to: a light string, light ribbon, strip lighting, tape light, flexible lighting, gas lights, electrical lights, natural lights, candles, or lamps. In an embodiment, the source of illumination (300) may have special uses, properties or affects, including but not limited to: single color lights, multi-color lights, flashing lights, blinking lights, strobe lights, runway lights, or black lights. In an embodiment, the source of illumination (300) is illuminated such that each aperture (501) is illuminated in a designated sequence. In a similar embodiment, the apertures (501) are shaped like frames of an animation and when the source of illumination (300) is illuminated such that each aperture (501) is illuminated in a designed sequence, the apparatus presents the impression of an animation progressing along the apparatus.

The illuminable surface (205) may be made from any material of sufficient rigidity to maintain its own shape, including but not limited to: aluminum, cast iron, lead, zinc, copper, steel, stainless steel, a metal alloy, a galvanized metal or steel, PVC, plastic, vinyl, concrete, stone, or wood. In an embodiment, the illuminable surface (205) is made from the same material or materials as another element of the rain gutter illumination system (100). In an embodiment, the illuminable surface (205) is made from a different material or materials than another element of the rain gutter illumination system (100).

Although in the depicted embodiment the illuminable surface (205) has one large, generally orthogonal aperture (210) through which the source of illumination (300) projects illumination, in an embodiment the aperture (210) may be of any size, shape, or configuration. For example, in the embodiment depicted in FIG. 5, the illuminable surface (901) has multiple apertures (903) in different, decorative shapes, and the illuminable surface (901) provides the decorative element of the apparatus. This use may be preferred where the desired decorative character of the apertures (903) is fixed. By way of example and not limitation, one such use is by commercial enterprises wherein the decorative shapes of the apertures (903) are themed to match the goods or services offered or sold by the enterprise, such as a retail store, restaurant, or vacation resort.

In an embodiment, the cover (200) is removable and/or detachable from the rain gutter (102) and/or building (101) and may be removed and/or detached as needed, including but not limited to for cleaning, repair, replacement, improvement, and maintenance. In the typical mode of use, the cover (200) is attached to the rain gutter (102) and left in place indefinitely. In an embodiment, there may be one or more gaps between the cover (200) and rain gutter (102). In an embodiment having one or gaps between the cover (200) and rain gutter (102), one or more of the gaps may be partially or fully filled with a waterproofing barrier, including without limitation a butyl sealant.

Figure 4:
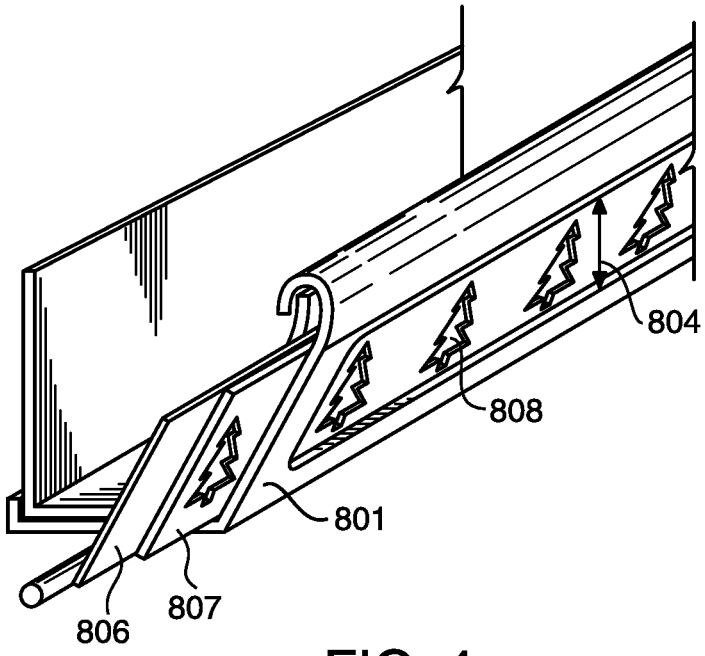
FIG. 4 provides an assembled view of an embodiment of the rain gutter illumination system. In this embodiment, the rain gutter illumination system includes an embodiment of a diffusing panel insert, and a decorative insert.

In the embodiment depicted in FIG. 4, the apparatus includes a decorative insert (807) placed in the apparatus such that the decorative insert (807) is visible through an aperture (804) in the illuminable surface (801), and the decorative insert (807) generally blocks illumination from being projected through the aperture (804) of the illuminable surface (801), except for where such illumination is projected through an aperture or apertures (808) in the decorative insert (807). In the depicted embodiment, the apparatus also includes a diffusing panel insert (806) but the apparatus may be used with a decorative insert (807) and without a diffusing panel insert (806). In an embodiment, the apparatus may have more than one decorative insert (807) and/or more than one diffusing panel insert (806). In an embodiment, some illumination may "bleed" through gaps between the decorative insert (807) and the illuminable surface (801), whether by or despite the design of the embodiment of the apparatus. In a further embodiment, the diffusing panel insert (806) may be held in place by additional components not depicted, including without limitation brackets and/or channels.

In an embodiment including a decorative insert (500), the decorative insert (500) may be changed from season to season and from event to event without having to change or alter the cover (200). This use may be preferred where the decorative character of the apparatus will change frequently. One such use is for a residential structure wherein the decorator of such structure wishes to match the décor of the structure with the holiday or season. Also by way of example and not limitation, another such use is for a commercial enterprise which hosts events at a location hall, wherein the décor of the location is changed to match a particular event at the location, such as a graduation, bar mitzvah, wedding, or retirement party. In an embodiment, the decorative insert (500) may be held in place by additional components not depicted, including without limitation brackets and/or channels. In an embodiment also including a diffusing panel insert (806) held in place by additional components, the same or different components may be used to hold the diffusing panel insert (806) and decorative insert (807, 500) in place.

In an embodiment, the decorative theme is or includes a religious or secular holiday or season, including, but not limited to: New Year's Day, Boxing Day, Valentine's Day, President's Day, St. Patrick's Day, Easter, Lent, Mardis Gras, May Day, Cinco de Mayo, April Fool's Day, Good Friday, Chinese New Year, Labor Day, Memorial Day, Columbus Day, Flag Day, Armed Forces Day, Independence Day, Father's Day, Mother's Day, Halloween, Thanksgiving, All Saint's Day, Christmas, Advent, Chanukah, Yom Kippur, or Rosh Hashanah.

In an embodiment, the decorative theme is or includes an event, occasion or cause, including, but not limited to: wedding, marriage, civil union, adoption, birth, graduation, anniversary, birthday, retirement, welcome home, welcome to the neighborhood, get well, shower, donation, bon voyage, proposal, good luck, congratulations, back to school, sympathy, military deployment or return, bar mitzvah, bat mitzvah, or gratitude.

In an embodiment, the decorative theme is or includes a hobby, interest, or organization, including but not limited to: games, video games, board games, gambling, poker, cards, television, photography, movies, music, dance, theater, opera, sports, motor sports, vacation, travel, military, carpentry, outdoor recreation, hunting, fishing, exercise, adventure, science, science fiction, fantasy, history, painting, pottery, cooking, food, dining, beer, wine, or spirits.

In an embodiment, the decorative theme is or includes letters, numbers, or other typographical glyphs, in any typesetting, font or style of any language or communicative means, including but not limited to: natural languages, artificial languages, fictional languages, dead languages, hieroglyphic languages, Morse code, computer programming languages, binary, octal, hexadecimal and Braille.

In an embodiment, the decorative theme is or includes a corporate or other commercial identity, including but not limited to a logo or trademark.

The decorative insert (500) may be made from any material of sufficient rigidity to maintain its own shape, including, but not limited to: aluminum, cast iron, lead, zinc, steel, copper, stainless steel, a metal alloy, a galvanized metal or steel, PVC, plastic, vinyl, concrete, stone, or wood. In an embodiment, the decorative insert (500) may be made from the same material or materials as another element of the rain gutter illumination system (100). In an embodiment, the decorative insert (500) may be made from a different material or materials than another element of the rain gutter illumination system (100).

Figure 2:
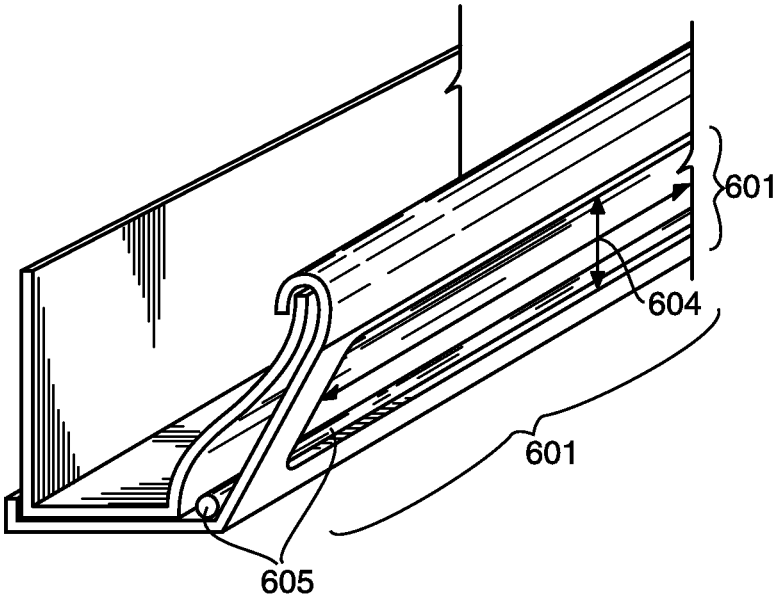
FIG. 2 provides an assembled view of an embodiment of the rain gutter illumination system. In this embodiment, the rain gutter illumination system does not include an embodiment of a diffusing panel insert, nor of a decorative insert.
Figure 3:
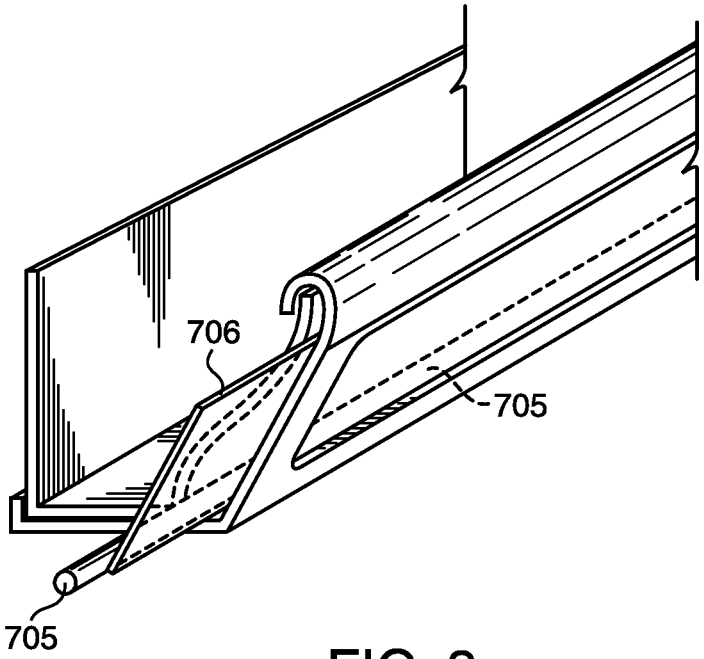
FIG. 3 provides an assembled view of an embodiment of the rain gutter illumination system. In this embodiment, the rain gutter illumination system includes an embodiment of a diffusing panel insert, but does not include an embodiment of a decorative insert.
Figure 5:
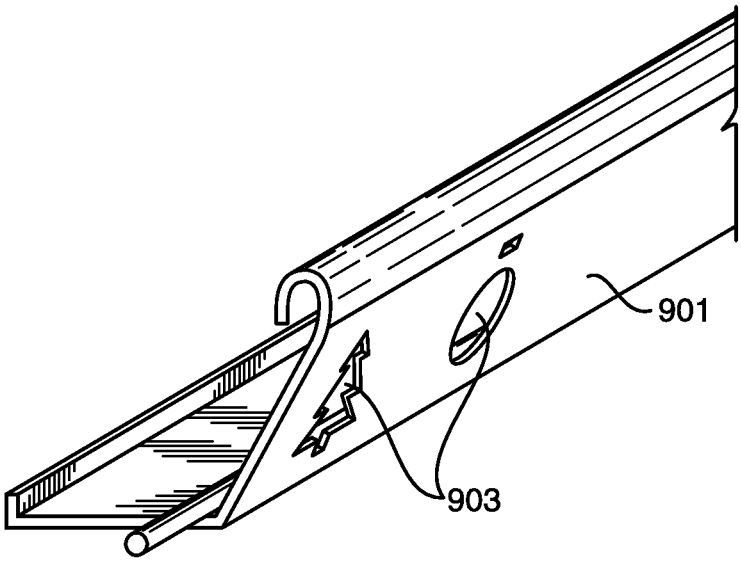
FIG. 5 provides an embodiment of the rain gutter illumination system. In this embodiment, the rain gutter illumination system does not include an embodiment of a diffusing panel, nor of a decorative insert. In this embodiment, the apertures in the illuminable surface are in a decorative shape.

In the embodiment depicted in FIG. 3, the apparatus includes a diffusing panel insert (706). The diffusing panel insert (706) serves a number of purposes, including without limitation to alter the character of the illumination projected from the apparatus by the source of illumination (705), such as by altering the distribution, color, pattern, texture, and/or intensity of the illumination. In an embodiment including a diffusing panel insert (706), a source of illumination (705) is placed behind the diffusing panel insert (706) such that illumination from the source of illumination (705) projects through the diffusing panel insert (706). In an embodiment also including the decorative insert (804), such as the embodiment depicted in FIG. 4, the diffusing panel insert (806) is placed behind the decorative insert (807). Although one purpose of the diffusing panel insert (806) is to alter the character of illumination passing through it, in an embodiment, the diffusing panel insert (806) prevents the transmission or project of most or all of the illumination projected by the source of illumination (705). As depicted in FIG. 2, the apparatus may have neither a diffusing panel insert (400) nor a decorative insert (500), and the source of illumination (605) projects illumination directly through an aperture (604) in the illuminable surface (601). As depicted in FIG. 5, apertures (903) in the illuminable surface (901) may be decorative in shape.

In an embodiment, the diffusing panel insert (400) makes more uniform the spectator's perceived distribution of the luminosity of the source of illumination (300). In an embodiment, the diffusing panel insert (400) is tinted or colored to alter such the color tone of the light projected through the diffusing panel insert (400) by the source of illumination (300). In an embodiment, the diffusing panel insert (400) contains one or more apertures. In an embodiment, the apertures in the diffusing panel (400) are in decorative shapes. In an embodiment, the diffusing panel insert (400) includes a color, tinting, texture, pattern, or other characteristic which alters the character of the illumination projected through the diffusing panel insert by the source of illumination (300). The diffusing panel insert (400) may vary in, among other things, transparency, translucence, color, texture, thickness, material, and/or pattern. The diffusing panel insert (400) may be made from any material of sufficient rigidity to maintain its own shape and which transmits illumination, including but not limited to: glass, fabric, paper, plastic, resins, cellophane, quartz, ice, ceramics, gel, or organic compounds.

While the invention has been disclosed in connection with certain preferred embodiments, this should not be taken as a limitation to all of the provided details. Modifications and variations of the described embodiments may be made without departing from the spirit and scope of the invention, and other embodiments should be understood to be encompassed in the present disclosure as would be understood by those of ordinary skill in the art.

The invention claimed is:

1. A rain gutter illumination system, said rain gutter illumination system comprising:

a cover sized and shaped for attaching to a rain gutter and comprising:

a hanger generally in an inverted U-shape and having a stem, said stem having a distal end;

a side element attached to said distal end of said stem, said side element being generally in the configuration of a longitudinally elongated contiguous rectangular prism and having an interior side and an opposing exterior side and an aperture from said interior side to said exterior side, said aperture extending substantially along the length of said side element;

a base, said base being generally L-shaped and having a leg and a foot, said foot having a proximal end attached to said leg and a distal end attached to said side element;

a decorative insert having a plurality of decorative apertures, said decorative insert being sized and shaped for sliding into said cover adjacent to said interior side of said side element such that at least one decorative aperture in said plurality of decorative apertures is visible from said exterior side of said side element through said aperture in said side element;

a source of illumination projecting illumination through said at least one visible decorative aperture such that an illuminated representation of said at least one visible decorative aperture is visible from said exterior side of said side element when said cover is installed on a rain gutter and said source of illumination is illuminated in said cover.

2. The rain gutter illumination system of claim 1, wherein said at least one decorative aperture is in the shape of a seasonally-themed symbol.

3. The rain gutter illumination system of claim 1, wherein said at least one decorative aperture is in the shape of a typographical glyph.

4. The rain gutter illumination system of claim 1, wherein said at least one decorative aperture is in the shape of a logo or trademark.

5. The rain gutter illumination system of claim 1, wherein said source of illumination is selected from the group consisting of: single-color lights, multi-color lights, flashing lights, blinking lights, strobe lights, runway lights, black lights.

6. The rain gutter illumination system of claim 1, wherein said rain gutter illumination system is further comprised of:

a diffusing panel insert sized and shaped for sliding into said cover adjacent to said decorative insert such that said illumination projected through said at least one visible decorative aperture is diffused by said diffusing panel.

7. The rain gutter illumination system of claim 6, wherein said diffusing panel insert is generally translucent.

8. The rain gutter illumination system of claim 6, wherein said diffusing panel insert is generally transparent.

9. A method for decorative illumination, said method comprising:

providing a cover sized and shaped for attaching to a rain gutter and having an illuminable side element generally in the configuration of an a longitudinally elongated contiguous rectangular prism, said side element having an aperture front the interior side to the exterior side of said side element, said aperture extending substantially along the length of said side element;

providing a source of illumination;

providing a decorative insert comprising a plurality of decorative apertures;

installing said cover on a rain gutter;

placing said decorative insert in said cover such that at least one decorative aperture in said plurality of decorative apertures is visible from said exterior side through said aperture in said side element;

placing said source of illumination in said cover;

illuminating said source of illumination;

projecting illumination from said source of illuminated source of illumination through said at least one decorative aperture.

10. The method for decorative illumination of claim 9, said method further comprising:

further providing a diffusing panel insert;

placing said diffusing panel insert in said cover;

diffusing said illumination projected through said at least one decorative aperture with said diffusing panel insert.

* * * * *